United States Patent [19]

Greeson

[11] 4,114,858

[45] Sep. 19, 1978

[54] TABLE TOP ASSEMBLY FOR VEHICLE BUMPER JACK

[76] Inventor: Thomas J. Greeson, 245 Graeme Dr., Nashville, Tenn. 37214

[21] Appl. No.: 854,713

[22] Filed: Nov. 25, 1977

[51] Int. Cl.[2] ..... B66F 11/00

[52] U.S. Cl. ..... 254/1

[58] Field of Search ..... 254/1, 133, 134; 108/11, 13

[56] References Cited

U.S. PATENT DOCUMENTS 1,666,084 4/1928 Bright ..... 108/11

3,830,470 8/1974 Gibson ..... 254/133

*Primary Examiner*—Robert C. Watson

*Attorney, Agent, or Firm*—Harrington A. Lackey

[57] ABSTRACT

A table top assembly for a vehicle bumper jack including a planar table top, a table support member including a pair of parallel spaced guide members secured to the bottom of the table top and a pair of jaws adapted to grip opposing surfaces of the column of the bumper jack and mounted between said guide members for relative longitudinal movement of said table top over the bumper jack.

8 Claims, 8 Drawing Figures

TABLE TOP ASSEMBLY FOR VEHICLE BUMPER JACK

BACKGROUND OF THE INVENTION

This invention relates to a table top assembly, and more particularly to a table top assembly especially adapted for supporting a table top upon the top of a bumper jack.

Heretofore, automobile mechanics and home craftsmen have had no convenient place for supporting their tools while working under the hood, or in the engine area, of a motor vehicle. The tools are normally kept upon a nearby work table or work bench, upon the ground, or upon the floor adjacent the vehicle, or laid upon the vehicle itself, subjecting the vehicle surface to scratching or marring.

The broad idea of a work table supported upon a column attached to the bumper of an automobile for the convenience of the person working upon the automobile, is disclosed in the Haigh U.S. Pat. No. 2,195,366. Nevertheless, Haigh's work table support requires its own, especially constructed support column, and does not utilize the advantage of supporting a table top upon a vehicle bumper jack.

SUMMARY OF THE INVENTION

It is therefore an object of this invention to provide a convenient work table for the vehicle motor mechanic or home craftsman utilizing the already available vehicle bumper jack as the column support for an especially constructed table top assembly.

The table top assembly made in accordance with this invention is especially constructed and adapted to support a table top upon the top of the column of a conventional vehicle bumper jack.

The table top assembly includes a planar table top of convenient size, to the bottom of which is secured a table support member or frame including a pair of elongated parallel guide members or rails. Mounted between the support members are a pair of jaws having opposing gripping surfaces for gripping opposite sides of the column of the bumper jack adjacent the top of the column. These jaws are adapted to be movable toward and away from each other and locked in fixed spaced relationship in order to tightly grip opposing surfaces of the jack column. The jaws are also provided with means cooperative with the guide members for longitudinal adjustable movement relative to the guide members. The guide members may include elongated tracks, such as elongated slots, receiving cooperative track follower members, such as follower pins to permit each jaw to be longitudinally moved relative to the guide members. The follower pins may also be threaded and provided with locking nuts for securing the jaws in various fixed positions along the guide members.

The construction of the table top assembly not only provides means for readily moving one or more of the jaws toward and away from each other for gripping and releasing the top portion of the jack column, but also provides means for moving both jaws relative to the table top so that the table top may be moved to various laterally adjustable positions relative to the jack column, for the convenience of the mechanic or craftsman.

The table top assembly is adapted to be readily removed from the bumper jack for storage, occupying a minimum of space, and also to release the bumper jack for its conventional intended use.

DESCRIPTION OF THE PREFERRED EMBODIMENT

Figure 1:
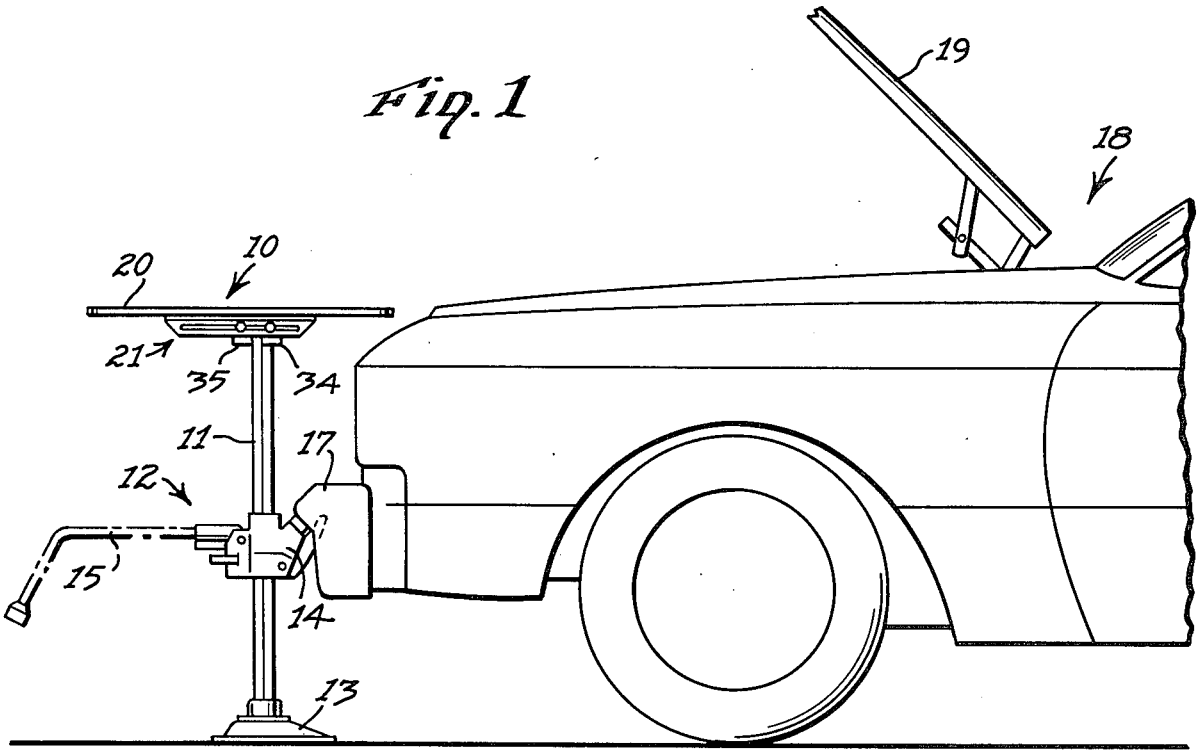
FIG. 1 is a side elevation of the table top assembly mounted upon a vehicle bumper jack secured to the front bumper of an automobile, shown fragmentarily.

Referring now to the drawings in more detail, FIG. 1 discloses a table top assembly 10, made in accordance with this invention, mounted on the top of the column 11 of a bumper jack 12. The bumper jack 12 has a base plate 13 and a bumper hook mechanism 14 for vertical adjustment upon the column 11 when the hook mechanism is actuated by the crank handle 15. The column 11, of course, is adapted to be maintained in a vertical position when the bumper hook mechanism 14 engages the front bumper 17 of the automobile 18. Thus, the table top assembly 10 is maintained in a convenient operative position adjacent the front end of the automobile 18, with the hood 19 raised, so that any tools supported upon the table top assembly 10 are readily available to the mechanic or home craftsman as he works within the engine area beneath the hood 19 of the automobile 18.

Figure 2:
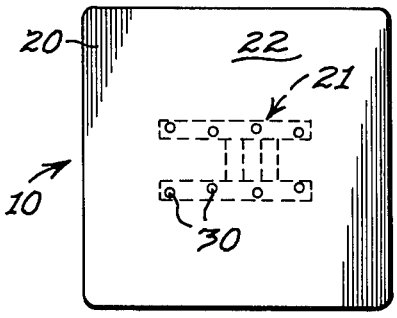
FIG. 2 is a top plan view of the table top assembly disclosed in FIG. 1.
Figure 3:
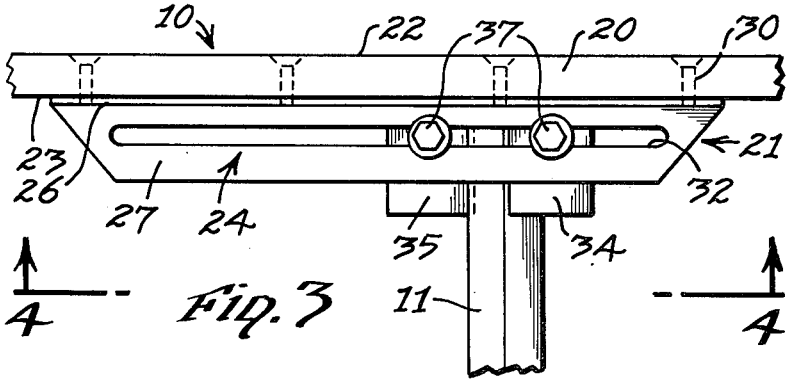
FIG. 3 is an enlarged, fragmentary side elevation of the table top assembly disclosed in FIG, 1.

The table top assembly 10 includes a planar table top 20 of any convenient size and shape, such as the square-shaped table top 20 illustrated in FIG. 2. The table top 20 may be made of any convenient material, such as plywood, which will support the weight of the desired tools, and which may be readily secured to the table support frame 21.

The table top 20 preferably includes an unobstructed top planar surface 22 and a bottom planar surface 23.

In the preferred form of the assembly 10, the table support frame 21 includes a pair of elongated guide members 24 and 25 of angular cross-section both of which have top horizontal, coplanar flanges 26 adapted to fit flush against the bottom surface 23 of the table top 20, and opposed spaced apart vertical parallel flanges 27. The top horizontal flanges 26 are provided with longitudinally spaced screw holes 29 for the reception of wood screws or bolts 30 extending through the thickness of the table top 20. The screws or bolts 30 secure the elongated guide members 24 and 25 to the bottom surface 23 in fixed position, spaced apart parallel to each other a predetermined distance. The screw holes 29 may be tapped, if desired, or nuts may be provided, for reception of the bolts 30, in order to secure the table top to the horizontal flanges 26.

Formed in the vertical flanges 27 are a pair of elongated tracks or slots 32 which are substantially coextensive and in horizontal alignment. Adapted to fit in the space between the vertical flanges 27 for free longitudinal movement therebetween are a pair of jaws 34 and 35.

Projecting laterally from opposite sides of each jaw 34 and 35 is a track follower or pin in the form of a threaded bolt 36 having a retainer head 37. The follower pins 36 project laterally through the corresponding guide slots 32, with the heads 37 on the opposite sides of the vertical flanges 27 from the jaws 34 and 35 to permit free longitudinal movement of each jaw 34 and 35 relative to the guide members 24 and 25. The bolt heads 37 may be tightened to turn the threaded pin members 36 within the corresponding tapped holes 38 within the opposite sides of the jaws 34 and 35, in order to hold each, or either, jaw 34 and 35 in a fixed position relative to the guide members 24 and 25.

Figure 4:
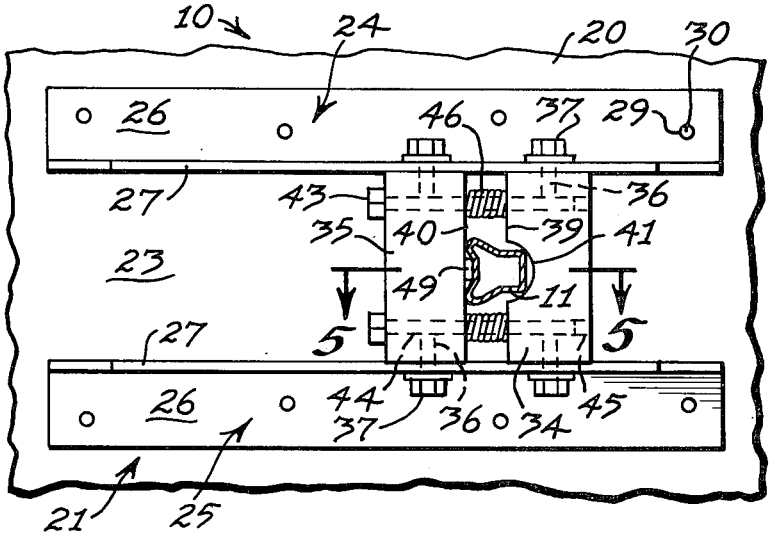
FIG. 4 is a section taken along the line 4—4 of FIG. 3.
Figure 6:
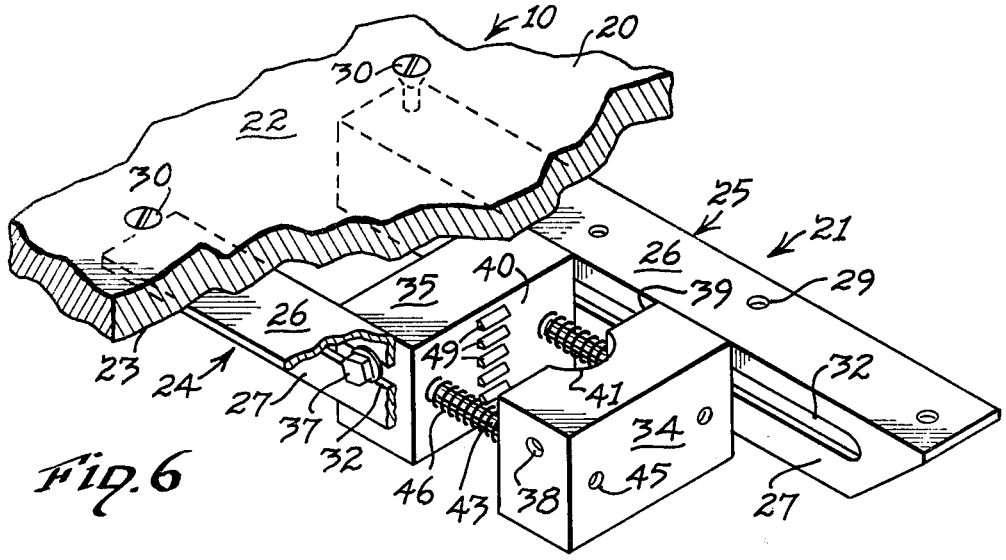
FIG. 6 is an enlarged, top, perspective view of the table top assembly, with portions broken away.

The gripping surfaces or faces 39 and 40 of the respective jaws 34 and 35, preferably have configurations generally conforming to the gripped surfaces of the column 11 of the bumper jack 12. It will be noted particularly in FIGS. 4 and 6 that the jaw 35 has a semi-cylindrical recess 41 in the gripping surface 39 in order to better receive and grip the corresponding surface of the jack column 11.

In order to more securely lock the jaws 34 and 35 in a relatively fixed spaced relationship, and particularly when the gripping faces 39 and 40 are engaging the opposite faces of the column 11, a pair of locking bolts 43 extend through corresponding holes 44 in jaw 35, with the threaded ends of the bolts 43 being threadedly secured in the tapped holes 45 of the jaw 34. By turning or tightening the bolts 43 in one direction, the jaws 34 and 35 are slowly moved together to securely grip and hold the opposing surfaces of the jack column 11, while counter-rotation of the bolts 43 will gradually move the jaws 34 and 35 away from each other to release the jack column 11.

In order to facilitate the release of the jaws 34 and 35, coiled compression springs 46 may be fitted around the respective bolts 43 between the opposed jaw faces 39 and 40.

Figure 5:
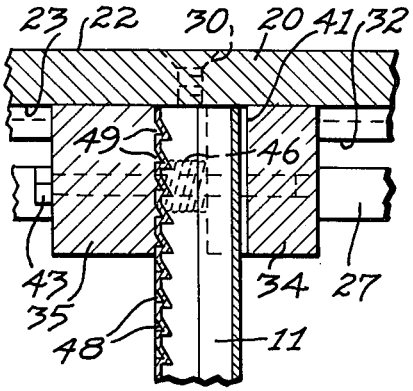
FIG. 5 is an enlarged section taken along the line 5—5 of FIG. 4.

In order to better grip the ratchet notches 48 upon the jack column 11, the gripping surface 40 may be provided with one or more projecting teeth 49 (FIG. 5). If a plurality of teeth 49 are employed, such as disclosed in the drawings, then they are preferably spaced vertically apart by the same increments as the ratchet notches 48 on the jack column 11.

Figure 7:
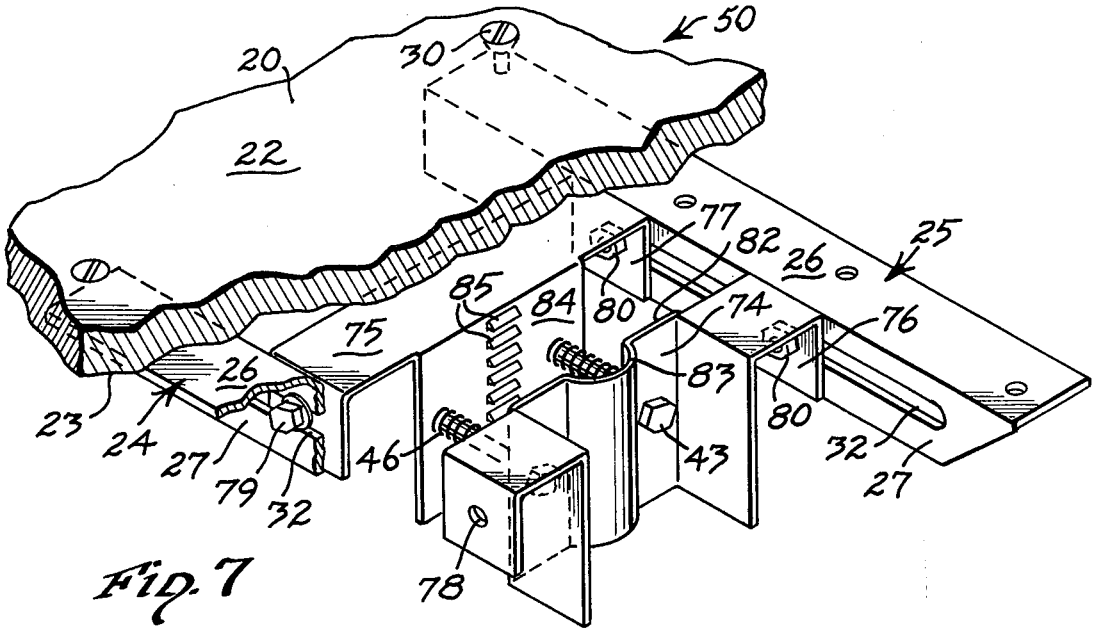
FIG. 7 is a view similar to FIG. 6, disclosing modified jaws.
Figure 8:
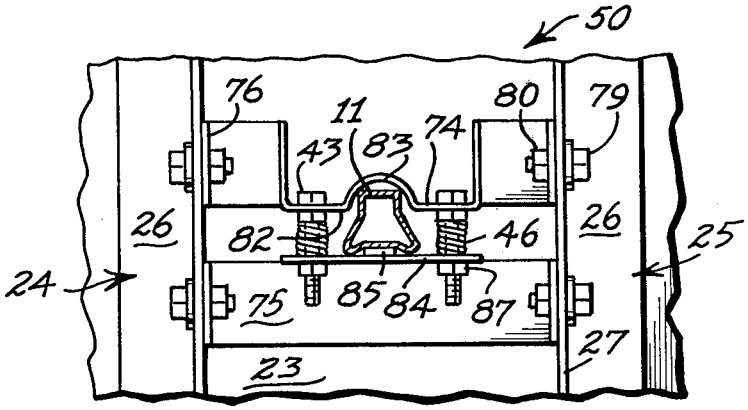
FIG. 8 is a fragmentary, bottom plan section similar to FIG. 4, but disclosing the modified jaws of FIG. 7.

The table top assembly 50 disclosed in FIGS. 7 and 8 is essentially the same construction as that of the table top assembly 10, except that the jaws 74 and 75 are made from stamped pieces of sheet metal, instead of being machined from solid blocks as are the jaws 34 and 35.

The jaws 74 and 75 have depending lateral ears 76 and 77 including pin or bolt holes 78 for receiving the track follower bolts 79 extending through the elongated track slots 32. Bolts 79 are secured to the ears 76 and 77 by nuts 80. The function of the follower bolts 79 is the same as the follower bolts 36.

The jaw face 82 of the stamped jaw 74 is also provided with a semi-circular recess 83, while the jaw face 84 of the jaw 75 is provided with one or more projecting teeth 85 having the same function as the teeth 49.

The same locking bolts 43 extend through corresponding holes in the jaws 74 and 75, but the threaded ends are secured by nuts 87, instead of the tapped holes 45.

Otherwise, the function of the table top assembly 50 is essentially the same as that of the table top assembly 10.

Referring to the table top assembly 10 disclosed in FIGS. 1–6, the table top 20 may be permanently attached to the support member 21 by the screws or bolts 30, or the screws 30 may be removed so that the table top 20 and the guide members 24 and 25 may be stored disassembled.

In a similar manner, the jaw 34 and 35 may be permanently secured for relative longitudinal slidable movement between the guide members 24 and 25, or they may be disassembled from the guide members 24 and 25 and from each other when not in use.

However, when it is desired to use the table top assembly 10, the table top 20 must be fixedly secured to the horizontal flanges 26 of the guide members 24 and 25 by the screws 30, and the jaws 34 and 35 must be assembled for longitudinal movement relative to each other and to the guide members 24 and 25 by the follower pins 36.

With bolts 43 loosened, the spaced jaws 34 and 35 are lowered over the top of the jack column 11, after the bumper jack 12 has been secured to the front bumper 17, with the jaws 34 and 35 disposed on opposite sides of the top of the column 11. The locking bolts 43 are then tightened until the jaws 34 and 35 securely engage and grip the opposed surfaces of the top of the column 11.

The table top 20 may then be adjusted in a horizontal plane normal to the vertical axis of the column 11 by loosening the bolt heads 37 and shifting the guide members 24 and 25 as a unit longitudinally relative to the jaws 34 and 35. For example, as disclosed in FIG. 1, it may be desired to move the table top 20 toward the automobile 18. After the table top 20 has been shifted to its desired position, then the bolt heads 37 are tightened to hold the table top 20 in a fixed position relative to the column 11.

The mechanic or home craftsman is then free to work upon the engine or other components beneath the hood 19 with his tools readily available upon the table top 20.

After the mechanic or craftsman is through with his work, he removes his tools, loosens the locking bolts 43 and removes the table top assembly 10 from the top of the column 11 of the bumper jack 12. The jack handle 15 is then actuated to lower and disengage the bumper hook 14 and the parts of the jack 12 are then stored independently of the table top assembly 10. The table top assembly 10 may itself be disassembled into its basic components, such as the table top 20, the guide members 24 and 25, and the jaws 34 and 35, or 74 and 75.

The entire table top assembly will fit, either assembled or unassembled, with ease into an automobile trunk or rear seat area for transportation to any desired location.

It is also possible to use the table top assemblies 10 and 50 mounted upon the column 11 of a bumper jack 12 for other purposes, such as an arm support or ammunition support for target shooting with rifles or pistols.

What is claimed is:

1. A table top assembly for a vehicle bumper jack having an elongated column of predetermined cross-section and a bumper hook longitudinally movable on said column, comprising:

(a) a table support member, (b) a table top, (c) means securing said table top to said table support member, (d) a pair of jaws having opposing gripping surfaces contoured to fit the opposing surfaces of the column of said bumper jack, (e) means securing said jaws to said support member for adjustable movement of at least one of said jaws toward and away from the other of said jaws in a longitudinal path relative to said table support member, for gripping the column of a vehicle bumper jack to support said table top on top of said column.

2. The invention according to claim 1 in which said table top is planar, said table support member comprising at least one elongated guide member parallel to said planar table top and means on said movable jaw cooperable with said guide member to support said movable jaw for longitudinal movement along said guide member.

3. The invention according to claim 2 in which the other of said jaws comprises means cooperable with said guide member for movement of said other jaw longitudinally relative to said guide member, whereby both said jaws are movable longitudinally of said guide member relative to each other and to said table top.

4. The invention according to claim 3 in which said table support member further comprises a second elongated guide member spaced from and parallel to said one guide member on opposite sides of said jaws, both said jaws having means cooperable with said guide member for longitudinal movement of either of said jaws along both said guide members, both said elongated guide members having coplanar top edges for abutting and supporting said planar table top.

5. The invention according to claim 4 in which said first and second elongated guide members have opposed longitudinal tracks, said cooperable means comprising track follower members projecting from opposite sides of both said jaws and received within said tracks for longitudinal movement along said guide members.

6. The invention according to claim 5 comprising means for securing each of said jaws in a fixed position relative to said guide members.

7. The invention according to claim 1 further comprising at least one locking bolt extending through one of said jaws and threadedly secured to the other of said jaws for locking said jaws in fixed spaced relationship for securely gripping the opposite surfaces of the column of said vehicle bumper jack.

8. The invention according to claim 1 in which one side surface of the column of the bumper jack includes vertically spaced ratchet notches, and the gripping surface of one of said jaws comprises at least one projecting tooth for engaging said ratchet notches in operative position for supporting said table top upon the top of said column.

* * * * *